US006659785B2

(12) United States Patent
Nakamura et al.

(10) Patent No.: US 6,659,785 B2
(45) Date of Patent: Dec. 9, 2003

(54) CONNECTOR

(75) Inventors: Hideto Nakamura, Yokkaichi (JP); Kei Yanagisawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/119,468

(22) Filed: Apr. 9, 2002

(65) Prior Publication Data

US 2003/0022542 A1 Jan. 30, 2003

(30) Foreign Application Priority Data

Jul. 25, 2001 (JP) ..... 2001-224825

(51) Int. Cl.[7] ..... H01R 29/00
(52) U.S. Cl. ..... 439/188
(58) Field of Search ..... 439/188, 489

(56) References Cited

U.S. PATENT DOCUMENTS 4,850,888 A 7/1989 Denlinger et al.
6,036,515 A * 3/2000 Nakamura ..... 439/188
6,039,589 A * 3/2000 LaLange et al. ..... 439/188
6,171,124 B1 * 1/2001 Kojima ..... 439/188
6,186,805 B1 * 2/2001 Krishnaswamy et al. ... 439/188
6,315,588 B1 * 11/2001 Heberlein et al. ..... 439/188

FOREIGN PATENT DOCUMENTS

JP 2000-357562 12/2000

* cited by examiner

*Primary Examiner*—Gary Paumen
(74) *Attorney, Agent, or Firm*—Gerald E. Hespos; Anthony J. Casella

(57) ABSTRACT

A connector has first and second housings (10, 30). The first housing (10) has male terminal fittings (13) and a shorting terminal (15) that is biased into shorting contact against the male terminal fittings (13). A pushing portion (36) displaces receiving pieces (20) of the shorting terminal (15) toward a bottom wall (12W) during connection of two housings (10, 20). The bottom wall (12W) has an escaping portion (22) for avoiding an interference with the receiving pieces (20). The receiving pieces (20) are displaced toward the bottom wall (12W) by the pushing portion (36) and enter the escaping portion (22). Thus the shorting terminal 15 is deformed to a large degree.

11 Claims, 6 Drawing Sheets

CONNECTOR

BACKGROUND OF THE INVENTION

1. Field of the Invention

The invention relates to a connector with a shorting terminal.

2. Description of the Related Art

Japanese Patent Application No. 2001-129191 and FIG. 7 herein both show a connector with a shorting terminal that was developed by the inventor of the subject invention. This connector includes a male housing 100 that is connectable with a female housing 110. A plurality of male terminal fittings 101 and a shorting terminal 102 are provided in the male housing 100. The shorting terminal 102 has terminal contacts 102A that contact and short the male terminal fittings 101 when the male and female housings 100 and 110 are not connected. Receiving pieces 102B are formed at the front end of the shorting terminal 102 and extend obliquely toward a side wall 103 of the male housing 100. The female housing 110 has a pushing portion 111 that contacts the receiving pieces 102B during connection to displace the receiving pieces 102B down in FIG. 7 and toward the side wall 103, thereby resiliently deforming the shorting terminal 102 and disengaging the terminal contacts 102A from the male terminal fittings 101. As a result, the shorted state of the female terminal fittings 101 is canceled.

Consideration has been given to elongating the receiving pieces 102B for more securely bringing the pushing portion 111 into contact with the receiving pieces 102B. Such a design ensures a wide permissible contact range of the pushing portion 111 with the receiving pieces 102B even if the female housing 110 shakes vertically or if a tolerance of dimensional precision or assembling precision is large. Therefore, the pushing portion 111 can be brought securely into contact with the receiving pieces 102B.

However, elongation of the receiving pieces 102B shortens the space between the side wall 103 of the male housing 100 and the leading ends of the receiving pieces 102B. Thus, a displacement stroke of the receiving pieces 102B becomes smaller, which leads to a smaller displacement stroke of the terminal contacts 102A of the shorting terminal 102. A small displacement stroke of the terminal contacts 102A prevents having a large space between the terminal fittings 101 and the shorting terminal 102 even after the shorted state of the terminal fittings 101 is canceled. This presents a problem in reliability of a shorted state canceling function.

In view of the above situation, an object of the present invention is to improve reliability of a shorted state canceling function.

SUMMARY OF THE INVENTION

The invention is directed to a connector with at least first and second housings that are connectable with each other. Terminal fittings and a shorting terminal are provided in the first housing. The shorting terminal normally contacts and shorts the terminal fittings. However, a shorted state of the terminal fittings can be cancelled by resiliently or elastically deforming the shorting terminal out of engagement with the terminal fittings. Receiving pieces are formed at the leading end of the shorting terminal and extend oblique to a connecting direction of the housings and toward a side wall of the first housing. A pushing portion is provided in the second housing and is adapted to contact the receiving pieces and to displace them toward the side wall portion during connection of the housings. An escaping portion is provided at the side wall of the first housing for avoiding interference with the receiving pieces when the receiving pieces are displaced toward the side wall by the pushing portion.

The displaced receiving pieces enter the escaping portion. Thus, the receiving pieces are displaced to a larger degree and the shorting terminal also is deformed to a larger degree as compared to a case where no escaping portion is provided. Accordingly, a large space is provided between the shorting terminal and the terminal fittings when the shorted state is canceled, and the reliability of a shorted state canceling function is improved.

The escaping portion preferably penetrates through the side wall first connector housing. Therefore, the receiving pieces can deflect a larger distance as compared to a case where a recess or bottomed hole is formed in the side wall.

The pushing portion preferably has a slanted surface oblique to the connecting direction of the housings. Additionally, the receiving pieces preferably have substantially the same inclination as the slanted surface before the shorting terminal contacts the pushing portion.

The second housing preferably has a recess that is continuous with the pushing portion and substantially parallel with the connecting direction of the housings. The shorting terminal is held in contact with the recess when the housings are connected with each other, thereby restricting displacement of the shorting terminal toward the terminal fittings.

The shorting terminal preferably comprises a plurality of resilient contact pieces folded back from a main section to extend towards the terminal fittings. The resilient contact pieces each comprise an angled terminal contact portion and an extending portion that extends forward from the front end of the terminal contact portion. The receiving piece extends oblique to the connecting direction of the housings from the front end of the extending portion.

The first connector housing preferably comprises a receptacle in which the second connector housing is insertable. A portion of the receptacle and the pushing portion define a space into which the shorting terminal is insertable when the connector housings are connected with each other.

These and other objects, features and advantages of the present invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 1:
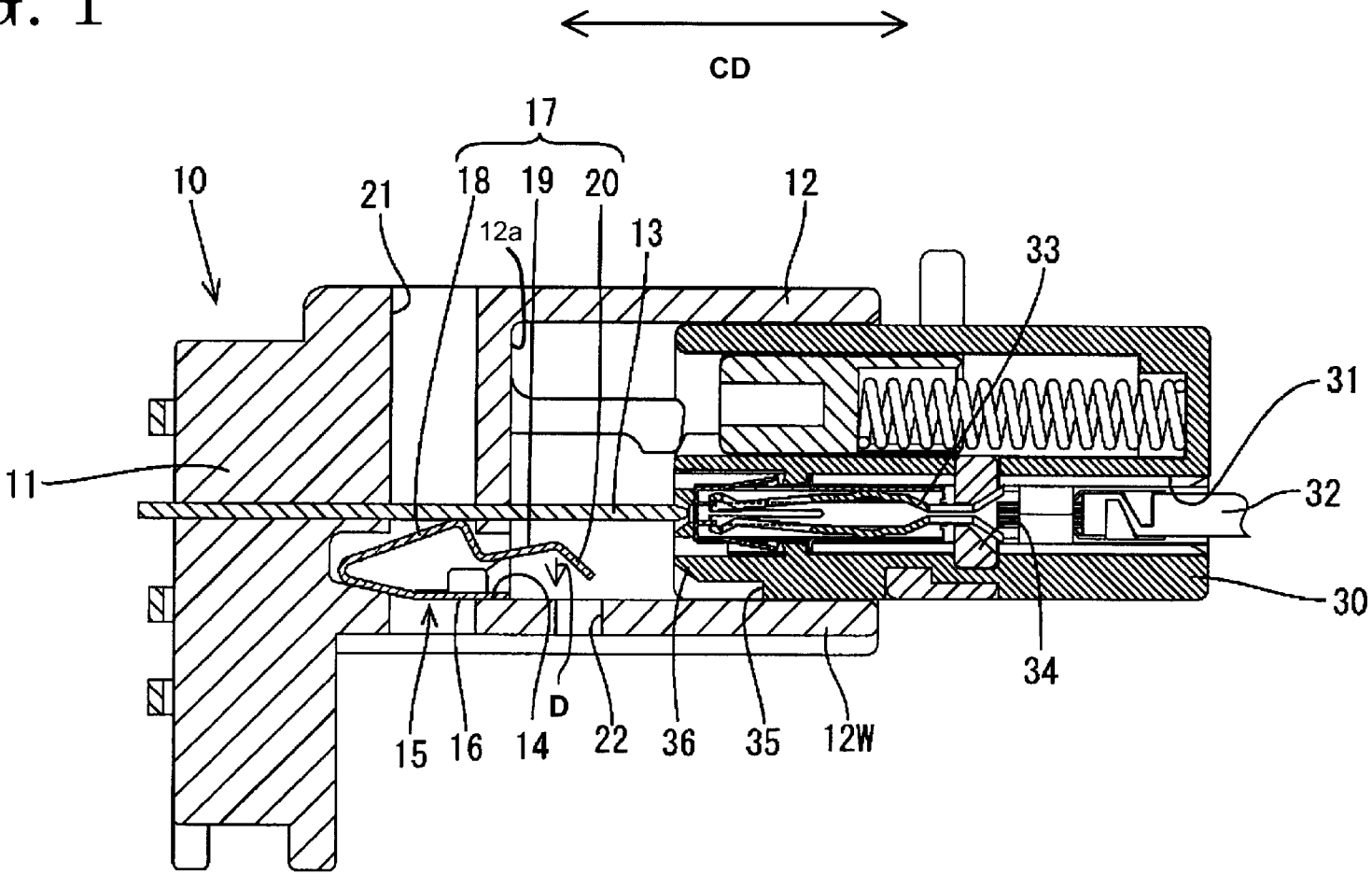
FIG. 1 is a section showing a state at the start of connection of male and female housings according to one embodiment of the invention.

A connector according to the invention is comprised of a male housing 10 and a female housing 30 that are connectable with each other. Ends of the housings 10, 30 to be connected with each other are referred to as front in the following description.

The male housing 10 is formed e.g. of a synthetic resin and is comprised of a housing main body 11 and a rectangular tubular receptacle 12 that projects forward from the housing main body 11. Male terminal fittings 13 are provided substantially side by side at the same height in the housing main body 11, and leading ends of the terminal fittings 13 project into the receptacle 12. The female housing 30 is fittable into the receptacle 12.

The housing main body 11 is formed with an accommodation space 14 that is open in the back end wall 12*a* of the receptacle 12, and a shorting terminal 15 is fixed in the accommodation space 14. The shorting terminal 15 has a substantially plate-shaped main section 16. Four resilient contact pieces 17 are folded back at the rear end of the main section 16 and extend forward. The shorting terminal 15 is fixed by holding the main section 16 in close contact with the bottom surface of the accommodation space 14. Each resilient contact piece 17 is comprised of an angled terminal contact 18, an extension 19 that extends substantially horizontally forward from the front end of the terminal contact 18, and a receiving piece 20 that extends obliquely forward to the bottom from the front end of the extension 19.

The housing main body 11 has exposure spaces 21 for exposing the bottom surfaces of the male terminal fittings 13 to the accommodation space 14. The terminal contacts 18 of the shorting terminal 15 are positioned to correspond to the exposure spaces 21. When the female housing 30 is not connected, the terminal contacts 18 of the shorting terminal 15 contact the bottom surfaces of the male terminal fittings 13 in the exposure spaces 21 with a specified contact pressure ensured by the resilient or elastic restoring force of the shorting terminal 15. Thus, the shorting terminal 15 shorts the male terminal fittings 13. When the female housing 30 is fitted to the male housing 10, the shorting terminal 15 is deformed resiliently or elastically to move the terminal contacts 18 away from the male terminal fittings 13, as described later, thereby canceling the shorted state of the male terminal fittings 13.

The receiving pieces 20 at the leading end of the shorting terminal 15 are at positions in the receptacle 12 distanced from the back end surface 12*a* of the receptacle 12 and extend from the extensions 19 obliquely to a connecting direction CD of the housings 10, 30 toward a bottom wall 12W of the receptacle 12. An escaping hole 22 penetrates through the bottom wall 12W to the outer surface of the receptacle 12. The escaping hole 22 is spaced from the back end surface 12*a* of the receptacle 12 by a distance substantially equal to the distance of the receiving portions 20 from the back end surface 12*a*. Additionally, the escaping hole 22 has a cross-sectional area corresponding to the area of the receiving pieces 20.

The female housing 30 is formed e.g. of a synthetic resin into a substantially block shape, and has e.g. four side-by-side cavities 31. Female terminal fittings 33 connected with ends of wires 32 are inserted into the respective cavities 31 from behind, and are locked by a retainer 34 so as not to come out. The respective female terminal fittings 33 are connected with the male terminal fittings 13 by connecting the two housings 10, 30 with each other.

A recess 35 is open at the front end of the bottom surface of the female housing 30 and extends substantially parallel to the connecting direction CD of the housings 10, 30. A space S is defined between a ceiling surface of the recess 35 and the bottom wall 12W of the receptacle 12 for receiving the extensions 19 of the shorting terminal 15 and rear ends of the receiving pieces 20 when the female housing 30 is fit into the receptacle 12. The front end of the ceiling surface of the recess 35 serves as a pushing portion 36 for the receiving pieces 20 of the shorting terminal 15. The pushing portion 36 is at substantially the same height along a direction normal to the connecting direction CD of the two housings 10, 30 as the receiving pieces 20 that are held in contact with the male terminal fittings 13. The pushing portion 36 comprises a slanted surface 37 that is oblique to the connection direction CD of the connector housings 10, 30 and preferably at the same angle of inclination as the receiving pieces 20. The slanted surface 37 contacts the respective receiving piece 20 when the connector housings 10, 30 are connected, and deflects the shorting terminal 15 smoothly away from the terminal fittings 13.

With the two housings 10, 30 separated from each other, the terminal contacts 18 of the shorting terminal 15 contact and short the male terminal fittings 13. Accordingly, there is no potential difference between the male terminal fittings 13. Further, the receiving pieces 20 of the shorting terminal 15 are in the receptacle 12 and are oblique to the connecting direction CD of the two housings 10, 30, as shown in FIG. 1.

Figure 2:
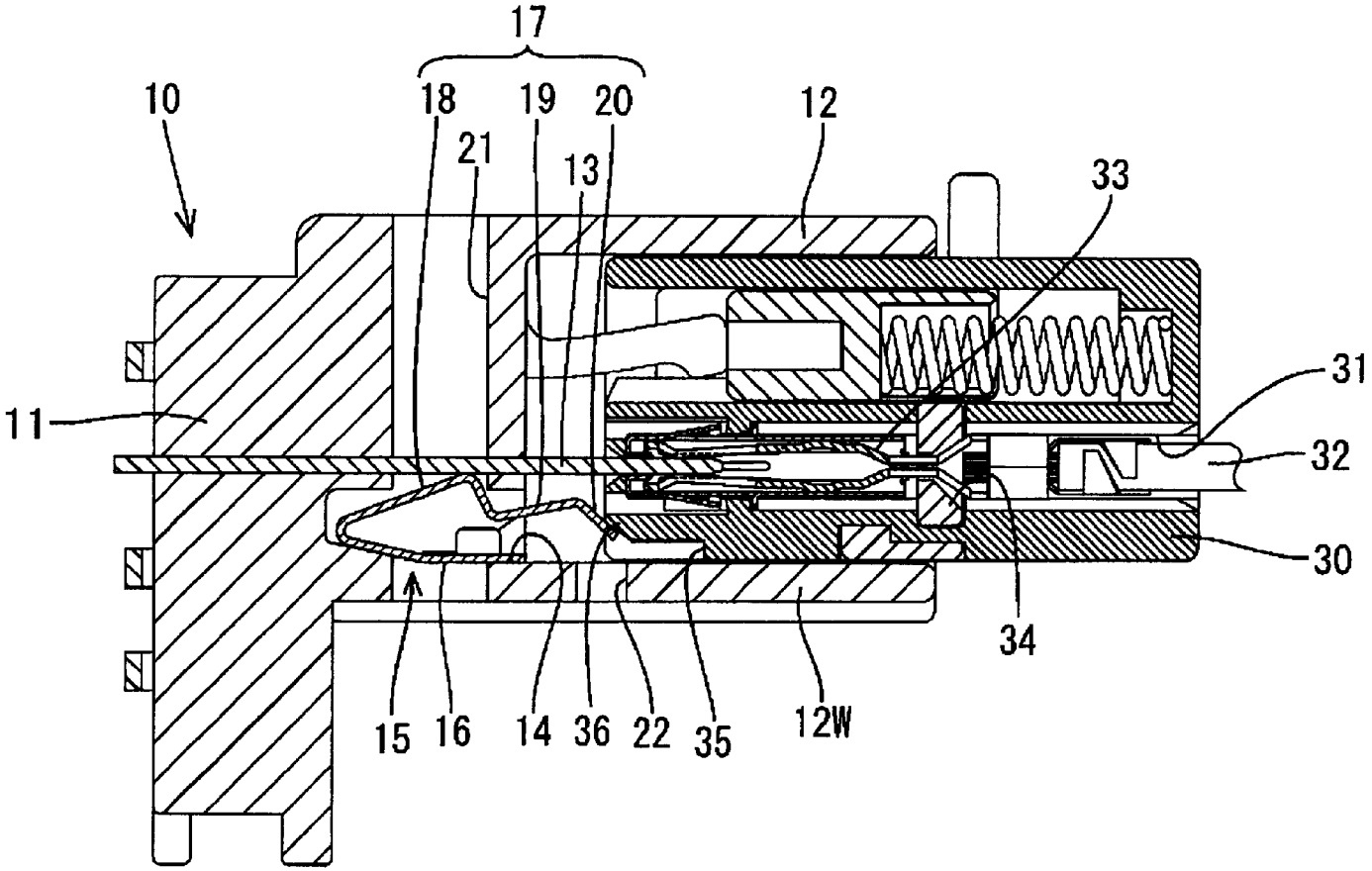
FIG. 2 is a section showing a state where a pushing portion of the female housing comes into contact with a shorting terminal during connection of the two housings.
Figure 3:
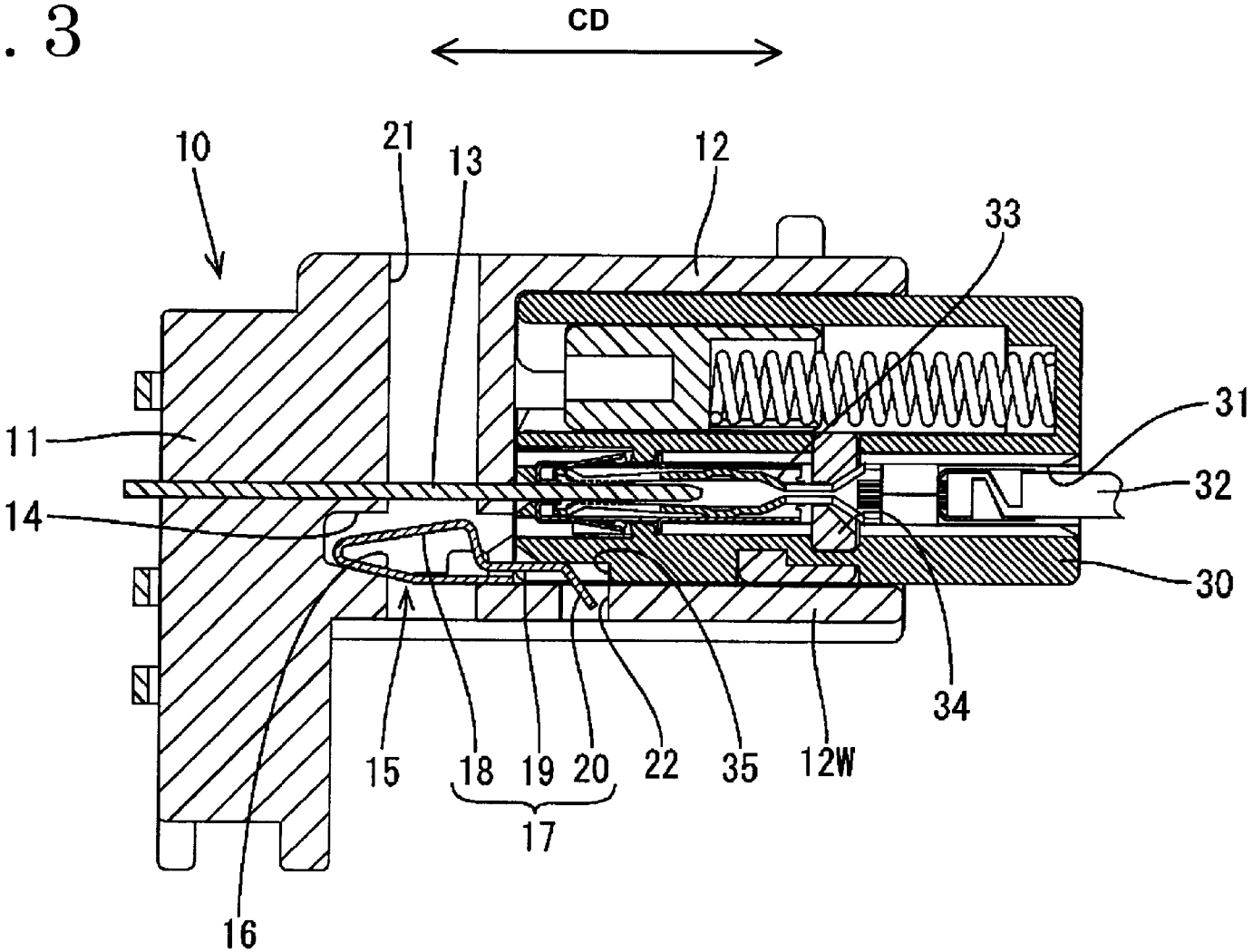
FIG. 3 is a section showing a state where the two housings are properly connected with each other to cancel a shorted state of male terminal fittings.
Figure 4:
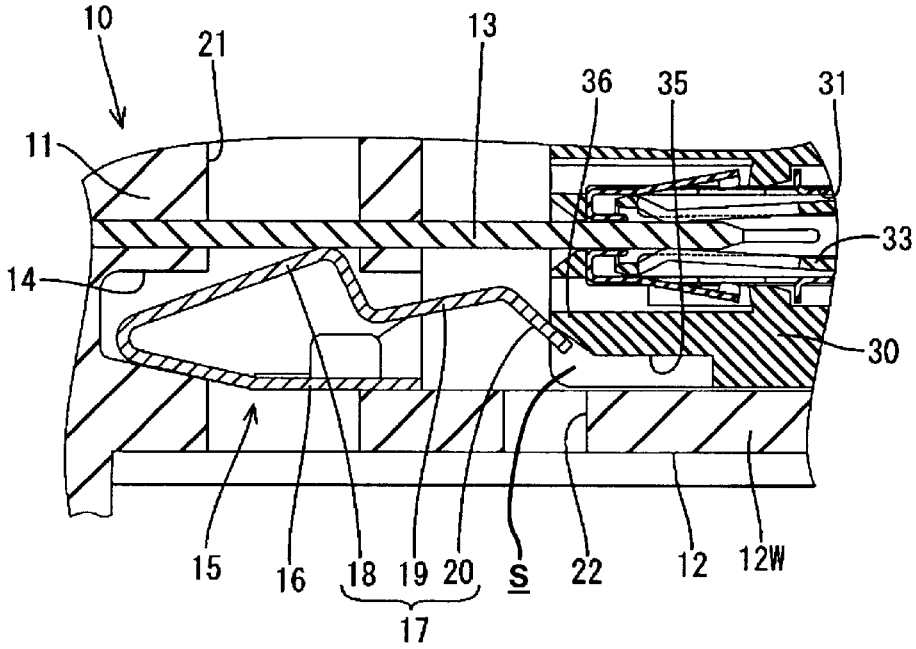
FIG. 4 is a partial enlarged section showing a state where the pushing portion is in contact with receiving pieces.
Figure 5:
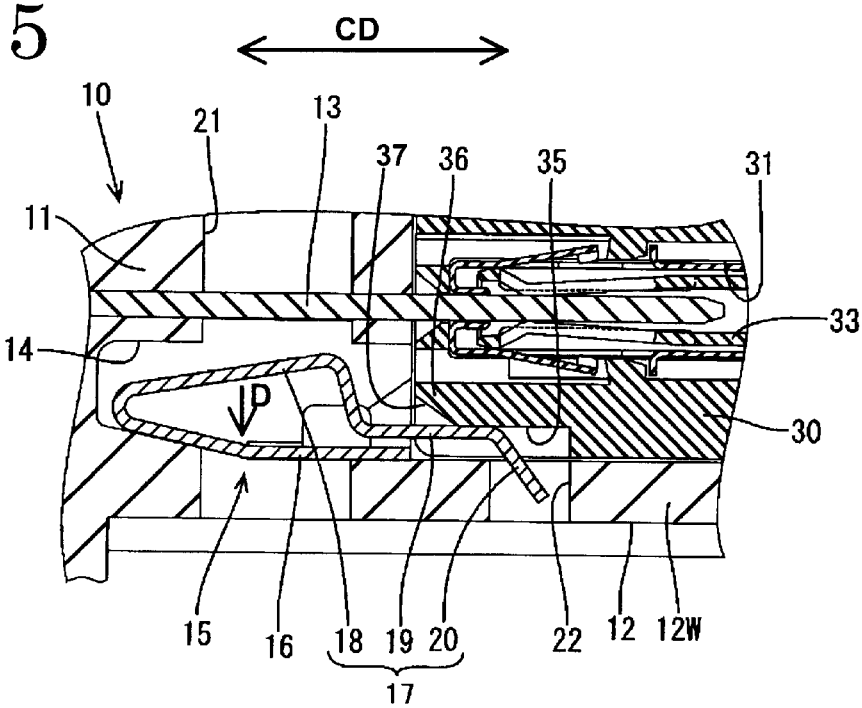
FIG. 5 is a partial enlarged section showing a state of the receiving pieces having entered an escaping portion.
Figure 6:
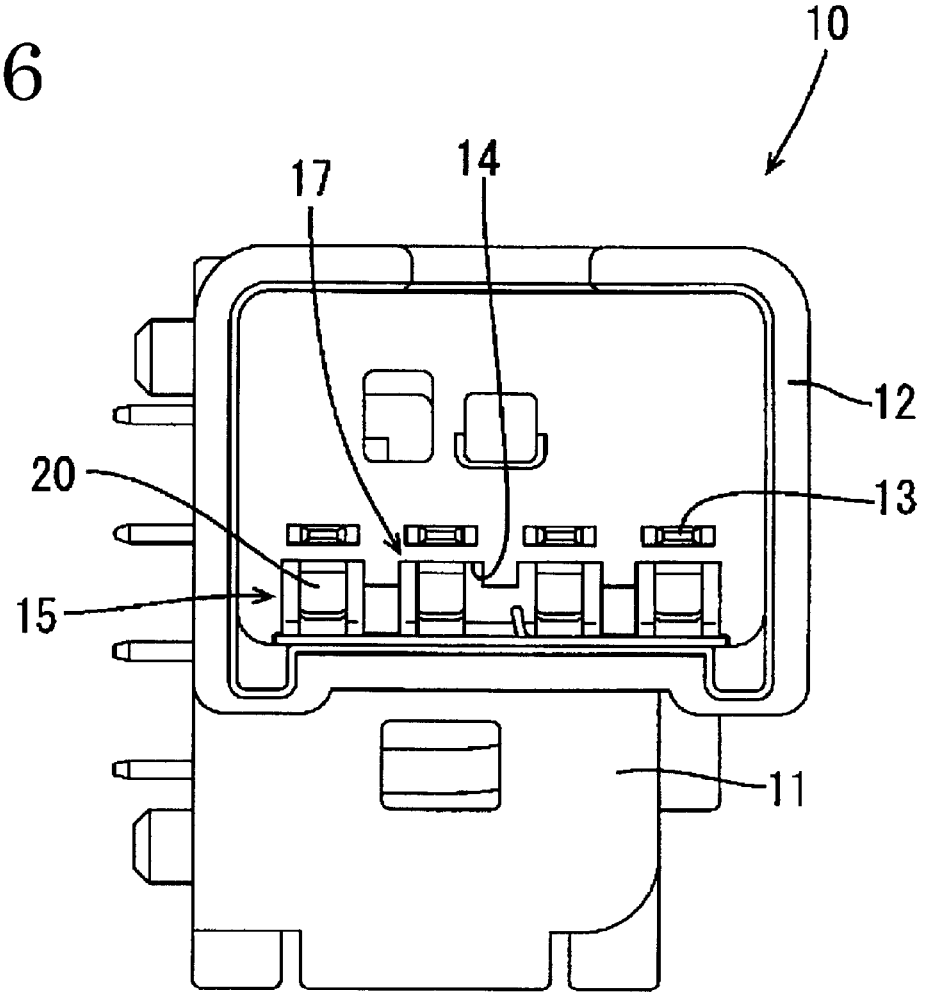
FIG. 6 is a front view of the male housing.
Figure 7:
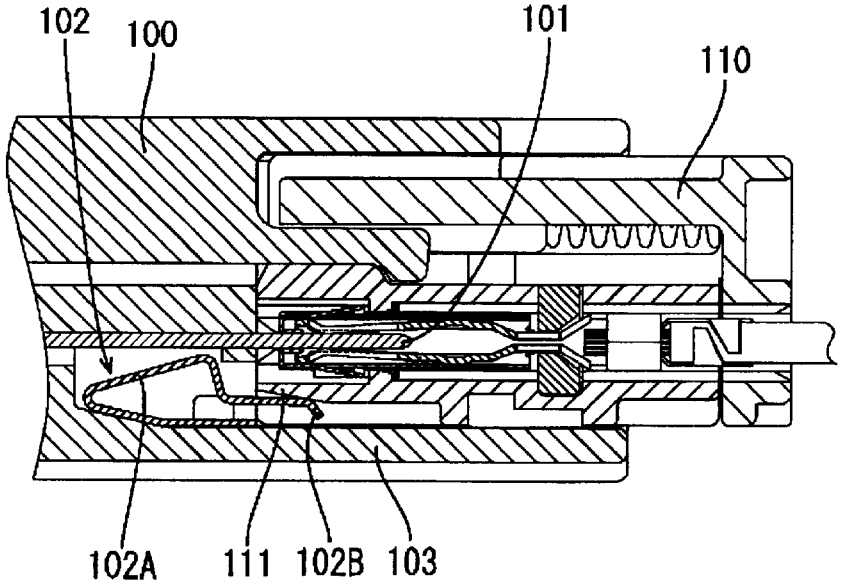
FIG. 7 PRIOR ART
FIG. 7 is a section of a prior art connector.

The female housing 30 can be inserted into the receptacle 12 in this state so that the pushing portion 36 of the female housing 30 contacts the receiving pieces 20, as shown in FIGS. 2 and 4. The inclination of the receiving pieces 20 and/or the slanted surface 37 causes the pushing portion 36 to displace the receiving pieces 20 smoothly down and away from the male terminal fittings 13 as the connection of the housings 10, 30 proceeds. The displacement of the receiving pieces 20 is transmitted to the terminal contacts 18 via the extensions 19. As a result, the shorting terminal 15 is deformed resiliently or elastically to displace the terminal contacts 18 downward and away from the male tab terminals 13. When the two housings 10, 30 are connected properly, the terminal contacts 18 are disengaged from the male terminal fittings 13, as shown in FIGS. 3 and 5, thereby canceling the shorted state of the male terminal fittings 13.

The leading ends of the receiving pieces 20 that have been pushed toward the bottom wall 12W by the pushing portion 36 enter the escaping hole 22 when connection of the housings 10, 30 proceeds to a certain degree. As connection of the two housings 10, 30 proceeds, the receiving pieces 20 enter deeper into the escaping hole 22, and achieve a maximum insertion as the receiving pieces 20 disengage from the bottom edge of the pushing portion 36. The receiving pieces 20 enter the recess 35 in the bottom surface of the female housing 30 after disengaging from the pushing portion 36, and are substantially parallel to the connecting direction CD of the connector housings 10, 30. Thereafter, the receiving pieces 20 are pressed by the ceiling surface of the recess 35 and remain at a specified height until the housings 10, 30 are connected completed.

The pushing portion disengages from the receiving pieces 20 during the withdrawal of the female housing 30 from the receptacle 12. Thus, the shorting terminal 15 is restored resiliently upward to bring the terminal contacts 18 into contact with the male terminal fittings 13.

As described above, the receiving pieces 20 are displaced toward the bottom wall 12W by the pushing portion 36 and enter the escaping hole 22 without interference with the bottom wall 12W. Consequently, the receiving pieces 20 are displaced to a larger degree as compared to a case where no escaping hole 22 is provided. The shorting terminal 15 also is displaced resiliently to a large degree and a large space is provided between the terminal contact portions 18 of the shorting terminal 15 and the bottom surfaces of the male terminal fittings 13 when the shorted state is canceled. Therefore, reliability of a shorted state canceling function can be improved.

The receiving pieces 20 penetrate the escaping portion 22 through the bottom wall 12W, and thus deflect a larger distance as compared to a case where a recess is formed in the bottom wall 12W instead of a through hole.

The present invention is not limited to the above described and illustrated embodiment. For example, following embodiments are also embraced by the technical scope of the present invention as defined in the claims. Beside the following embodiments, various changes can be made without departing from the scope and spirit of the present invention as defined in the claims.

The terminal fittings 13 and the shorting terminal 15 are provided in the male housing 10 and the pushing portion 36 is provided in the female housing 30 in the foregoing embodiment. However, the terminal fittings and the shorting terminal may be provided in the female housing and the pushing portion may be provided in the male housing.

Although the escaping portion 22 is a hole penetrating through the side wall portion in the foregoing embodiment, it may be a bottomed recess.

Although the slanted surface 37 is formed on the pushing portion 36 in the foregoing embodiment, it may be an angled or rounded edge.

What is claimed is:

1. A connector, comprising:

first and second housings that are connectable with each other along a connecting direction;

a plurality of terminal fittings provided in the first housing;

a shorting terminal provided in the first housing and adapted to normally contact and short the terminal fittings and being resiliently deformable away from the terminal fittings for canceling a shorted state of the terminal fittings;

receiving pieces formed at the leading end of the shorting terminal and extending oblique to the connecting direction of the housings toward a side wall of the first housing, and a pushing portion provided in the second housing and adapted to resiliently deform the shorting terminal in a direction away from the terminal fittings by contacting the receiving pieces to displace them toward the side wall during connection of the housings, wherein a through hole extends entirely through the side wall of the first connector housing aligned with the receiving pieces for receiving the receiving pieces and avoiding interference with the receiving pieces when the receiving pieces are displaced toward the side wall by the pushing portion.

2. The connector of claim 1, wherein the pushing portion has a slanted surface oblique to the connecting direction of the housings.

3. The connector of claim 2, wherein the receiving pieces have substantially an identical inclination as the slanted surface before the shorting terminal contacts the pushing portion.

4. The connector of claim 1, wherein the second housing is formed with a recess which is continuous with the pushing portion and substantially parallel with the connecting direction of the housings, and the shorting terminal is held in contact with the recess when the housings are connected with each other, thereby restricting displacement of the shorting terminal toward the terminal fittings.

5. The connector of claim 1, wherein the shorting terminal comprises a plurality of resilient contact pieces folded back from a main section and extending towards the terminal fittings.

6. The connector of claim 5, wherein the resilient contact pieces each comprise an angled terminal contact and an extending portion extending from the terminal contact, the receiving piece extending in a direction oblique to the connecting direction of the housings.

7. The connector of claim 1, wherein the first housing comprises a receptacle in which the second housing is insertable, wherein a portion of the receptacle and the pushing portion define a space into which the shorting terminal is insertable when the housings are connected with each other.

8. A connector, comprising a first housing having a tubular receptacle with an open front end and a bottom wall, a plurality of terminal fittings mounted in the first housing and projecting forwardly into the receptacle along a connecting direction, a shorting terminal mounted in the first housing and having resilient contact pieces cantilevered forwardly in the receptacle and biased into contact with each of said plurality of terminal fittings defining portions of the respective resilient contact pieces closest to the open front end of the receptacle and being aligned obliquely toward the bottom wall, each of said receiving pieces defining a height measured normal to the connecting direction, the bottom wall comprising at least one hole formed completely therethrough at a location aligned with the receiving pieces for receiving the receiving pieces in response to deflection of the respective resilient contact piece, a second housing slidably insertable into the receptacle of the first housing along the connecting direction, the second housing having a pushing portion defining a slanted leading surface disposed for contact with the receiving pieces, the pushing portion being offset from the bottom wall of the receptacle by a distance less than the height of each said receiving piece, whereby the slanted surfaces of the pushing portion slidably engage the receiving pieces and deflect the resilient contact pieces sufficiently for moving the receiving pieces into the respective holes in the bottom wall of the receptacle.

9. The connector of claim 8, wherein the shorting terminal comprises a main section and the plurality of resilient contact pieces being folded back from the main section and extending towards the terminal fittings.

10. The connector of claim 9, wherein the resilient contact pieces each comprise an angled terminal contact and an extending portion extending from the terminal contact, the receiving piece extending oblique to the terminal fittings.

11. The connector of claim 8, wherein the receiving piece and the hole are disposed to avoid contact between the bottom wall and the receiving piece during deflection of the resilient contact piece.

* * * * *